US009125796B2

(12) United States Patent
He

(10) Patent No.: US 9,125,796 B2
(45) Date of Patent: Sep. 8, 2015

(54) PILL CRUSHER

(71) Applicant: Suzhou Sinnomed Technologies Co., Ltd, Suzhou (CN)

(72) Inventor: Guang He, Shanghai (CN)

(73) Assignee: Suzhou Sinnomed Technologies Co., Ltd., Suzhou (CN)

( * ) Notice: Subject to any disclaimer, the term of this patent is extended or adjusted under 35 U.S.C. 154(b) by 29 days.

(21) Appl. No.: 14/254,090

(22) Filed: Apr. 16, 2014

(65) Prior Publication Data

US 2014/0306048 A1 Oct. 16, 2014

(30) Foreign Application Priority Data

Apr. 16, 2013 (CN) ..... 2013 1 0130401
Apr. 16, 2013 (CN) ..... 2013 2 0214703 U

(51) Int. Cl.

| | |
|---|---|
| ***B02C 19/00*** | (2006.01) |
| ***A61J 7/00*** | (2006.01) |
| ***B02C 19/08*** | (2006.01) |
| ***B02C 1/00*** | (2006.01) |

(52) U.S. Cl.
CPC ..... *A61J 7/0007* (2013.01); *B02C 1/00* (2013.01); *B02C 19/08* (2013.01)

(58) Field of Classification Search
CPC ..... B02C 19/08; A61J 7/0007; Y10S 241/27
USPC ..... 241/168, 169.2, DIG. 27
See application file for complete search history.

(56) References Cited

U.S. PATENT DOCUMENTS 4,003,523 A * 1/1977 Doolittle ..... 241/169.2
4,121,775 A * 10/1978 Roseberg et al. ..... 241/30
5,823,451 A * 10/1998 Sharpe ..... 241/169.2
5,863,001 A * 1/1999 Schulze ..... 241/30
5,924,636 A * 7/1999 Calderon ..... 241/84.3
6,059,209 A * 5/2000 Barson ..... 241/168
6,637,683 B1 * 10/2003 Wilbur ..... 241/101.2
6,637,685 B1 * 10/2003 Kruger ..... 241/169.1
7,252,254 B1 * 8/2007 Engel et al. ..... 241/168
7,364,102 B2 * 4/2008 Engel et al. ..... 241/169

(Continued)

*Primary Examiner* — Faye Francis
(74) *Attorney, Agent, or Firm* — McDonnell Boehnen Hulbert & Berghoff LLP

(57) ABSTRACT

A pill crusher is provided, which comprises a base, a stopper, an U-shaped movable pressing plate, a connecting rod and a handle, wherein the stopper is mounted on the base; the U-shaped movable pressing plate is sleeved on the outside of the stopper and comprises a pressing plate on one side of the stopper and two side walls connected with the pressing plate and pivotedly connected to the stopper, so that the U-shaped movable pressing plate can rotate relative to the stopper and a V-shaped crushing chamber formed between the pressing plate and the stopper is capable of being closed by pressing and being open; the connecting rod is positioned on the other side of the stopper and has a first end pivotedly connected with the stopper and a second end; the handle has a first end pivotedly connected with the second end of the connecting rod through a third shaft pin and a pivoting portion pivotedly connected with the two side walls; as the handle is pressed down, the angle between the connecting rod and the handle increases and the space of the V-shaped crushing chamber decreases gradually; and as the handle is raised up, the angle between the connecting rod and the handle reduces and the space of the V-shaped crushing chamber increases gradually. The pill crusher provided by the present invention has the advantages of labor saving, high efficiency, quietness, convenient maintenance and cleaning and the like.

16 Claims, 13 Drawing Sheets

(56) References Cited

U.S. PATENT DOCUMENTS

| | | | | |
|---|---|---|---|---|
| 7,413,137 | B2 * | 8/2008 | Donovan | 241/168 |
| 7,559,496 | B2 * | 7/2009 | Shewchuk | 241/169 |
| 8,376,256 | B1 * | 2/2013 | Ferguson | 241/169.2 |
| 2007/0164141 | A1 * | 7/2007 | Engel et al. | 241/169.2 |
| 2008/0093490 | A1 * | 4/2008 | Donovan | 241/169.2 |
| 2012/0187229 | A1 * | 7/2012 | Clouser et al. | 241/30 |

* cited by examiner

PILL CRUSHER

This application claims priorities to the following Chinese patent applications, the contents of which are incorporated herein by reference in their respective entireties:

1) Chinese Appl. No. 201310130401.4, entitled "pill crusher", filed on Apr. 16, 2013;

2) Chinese Appl. No. 201320214703.5, entitled "pill crusher", filed on Apr. 16, 2013.

TECHNICAL FIELD

The present invention relates to a medical device for assisting medicine administration, in particular to a pill crusher.

BACKGROUND

Most oral drugs are taken by the patients in the form of pills with different shapes and sizes. The pills are produced into preparations in disc or anomalous shape by special forming process after uniform mixing of drugs and adjuvant materials, which are widely applied in the modern pharmaceutical industry, for having the advantages of accurate dosage, stable quality, convenient to carry and transport, and the like. In accordance with the requirements in various aspects such as treatment, the dosage of a single pill and the proportion of raw materials to adjuvant materials, different drugs have different requirements on the shape, the size or other characteristics of the pills. For instance, vitamin pills, calcium pills and the like are usually larger, which are inconvenient for ordinary people to take one or more once, particularly for those special patents, such as the aged, children, postoperative patients, dysphagia patients or coma patients, who have difficulty in directly taking the pills, and thereby limiting the use of oral drugs and even affecting the treatment of patients.

Therefore, a device capable of crushing appropriate pills into pieces or powder (i.e. pill crusher) is required, in order to assist the patients who need but cannot normally take standard preparations to take medicine for deserved treatment. The pill crusher should be safe, high efficient, low cost, quiet, labor-saving and easy to use and can avoid the cross-contamination of drugs. However, the traditional pill crushers, e.g., "pot for pounding drugs", generally employ the means of simple shock and grinding or employ a single lever to realize the action of crushing pills, which have the defect of low efficiency, loud noise, labor-consuming, quantity loss or the cross-contamination of pills and the like in the crushing process, and hence cannot fully meet the requirements of crushing the pills safely and efficiently. In particular, when pill crushers are used by medical personnel at medical institutions, their characteristics such as the crushing speed, efficiency, quietness, exogenous contamination/cross-contamination avoidance, labor-saving level and the like are especially important.

For instance, U.S. Pat. No. 7,413,137, with the inventor of James A. Donovan, filed on Sep. 21, 2006, provides a device, in which the bent-lever principle is utilized to convert the rotation of a handle into the parallel movement of a platen and further drive the platen to press towards a fixed plate to crush the pills between them and realize the objective of pill crushing, while the platen and the fixed plate are set on a same base. However, as the structure of this device is too complex, it has a lot of friction and relatively loud noise during its using process and make the crushing process inconvenient and high costly, this device cannot fully meet the users' needs. Moreover, for instance, the U.S. Pat. No. 3,915,393, with the inventor of Bill Webb Elkins, filed on Apr. 24, 1974, provides a device which simply utilizes the single-lever principle to convert the rotation of a handle into the downward pressing action so as to crush pills. But this single-lever structure, which cannot effectively provide the magnification factor of force, is labor-consuming, and particularly it is inconvenient to repeatedly crush lots of pills for a plurality of times when used in medical institutions. Furthermore, for instance, the U.S. Pat. No. Des. 337,828, with the inventor of David W. Gordon, filed on Dec. 12, 1990, provides a simple and portable pill crusher, which employs the principle of threaded rotation to convert rotation into linear motion to realize the action of crushing pills. Although this structure is labor-consuming, it is simple, convenient for crushing, and particularly applicable to crush a small amount of pills by family or individual. However, the structure cannot meet the requirement of medical institutions for crushing a large amount of pills.

SUMMARY

The objective of the present invention is to provide a pill crusher, which overcomes the defects in the prior art and more fully meets the requirements such as safety, labor saving, high efficiency, low noise, easy processing, low cost, convenient maintenance and cleaning, and capability of effectively preventing cross-contamination.

As one aspect of the invention, a pill crusher comprises: a base; a stopper mounted on the base; an U-shaped movable pressing plate sleeved on outside of the stopper and comprising a pressing plate on one side of the stopper and two side walls connected with the pressing plate and pivotedly connected with the stopper, so that the U-shaped movable pressing plate can rotate relative to the stopper and a V-shaped crushing chamber formed between the pressing plate and the stopper is capable of being closed by pressing and being open; a connecting rod, positioned on the other side of the stopper and having a first end pivotedly connected with the stopper and a second end; and a handle having a first end pivotedly connected with the second end of the connecting rod through a third shaft pin and a pivoting portion pivotedly connected with the two side walls; as the handle is pressed down, an angle between the connecting rod and the handle increases and a space of the V-shaped crushing chamber decreases gradually; and as the handle is raised up, the angle between the connecting rod and the handle reduces and the space of the V-shaped crushing chamber increases gradually.

As another aspect of the invention, the stopper is an U-shaped fixed stopper including a stop plate fixed on the base and two side walls; lower portions of the two side walls of the U-shaped movable pressing plate are pivotedly connected with lower portions of the two side walls of the U-shaped fixed stopper through a first shaft pin; upper portions of the two side wall of the U-shaped fixed stopper are pivotedly connected with the first end of the connecting rod through a second shaft pin; and upper portions of the two side walls of the U-shaped movable pressing plate are pivotedly connected with the pivoting portion of the handle through a fourth shaft pin.

As another aspect of the invention, the stopper is an U-shaped semi-fixed stopper including a stop plate and two side walls; lower portions of the two side walls of the U-shaped movable pressing plate are pivotedly connected with lower portions of the two side walls of the U-shaped semi-fixed stopper through a first shaft pin; upper portions of the two side walls of U-shaped semi-fixed stopper are pivotedly connected with the first end of the connecting rod through a second shaft pin; and upper portions of the two side walls of the U-shaped movable pressing plate are pivotedly connected with the handle through a fourth shaft pin.

As a further aspect of the invention, the lower portions of the two side walls of U-shaped semi-fixed stopper are pivotedly connected with a fixed block on the base; free ends of the two side walls of U-shaped semi-fixed stopper are provided with compressible buffer springs respectively; one end of each buffer spring abuts against the side wall of U-shaped semi-fixed stopper elastically and the other end is elastically supported on the base to form a wedge space between bottom edges of the two side walls of the U-shaped semi-fixed stopper and the base.

As a further aspect of the invention, the free end of each side wall of the U-shaped semi-fixed stopper is provided with an m-shaped notch for accommodating the buffer spring.

As a further aspect of the invention, one or more of the second shaft pin, the third shaft pin and the fourth shaft pin are sleeved by an elastic bush respectively.

As a further aspect of the invention, a stop post for limiting a pressing-down distance of the handle is mounted on the base.

As a further aspect of the invention, a rubber pad is mounted on the top of the stop post.

As a further aspect of the invention, the stop plate or the pressing plate is provided with a plurality of anti-slip stripes or anti-slip patterns.

As a further aspect of the invention, the two side walls of the U-shaped semi-fixed stopper are L-shaped.

As a further aspect of the invention, the two side walls of the U-shaped movable pressing plate are inverted L-shaped.

As a further aspect of the invention, the pill crusher further comprises an upper cover detachably mounted on the base; and a pill crusher pouch dispenser is formed between the upper cover and the base.

As a further aspect of the invention, the upper cover partially covers the stopper and the U-shaped movable pressing plate, and has an opening for the handle to extend outwards.

The pill crusher provided by the present invention, having the V-shaped crushing chamber and the connecting rod, is good for users, particularly for users in medical institutions. More specifically, the pill crusher provided by the embodiments of the present invention fully utilizes the labor-saving principle of lever, particularly constructs a compressible and restorable wedge region via two buffer springs or make a favorable-changed leverage ratio resulting from the variable lever arm of the compressible elastic bush sleeved outside the shaft pin according the direction of its stress during the pill crushing process, which can increase the magnification factor of pressing force and meanwhile greatly buffer the reaction force of pill crushing and reduce the burden of the users and particularly the potential injuries to the wrist and elbow of medical personnel due to long-term use.

BRIEF DESCRIPTION OF THE DRAWINGS

For other characteristics, objectives and advantages of the present invention to be more obvious, detailed description will be given below to the specific embodiments with reference to the accompanying drawings.

DETAILED DESCRIPTION

Figure 1:
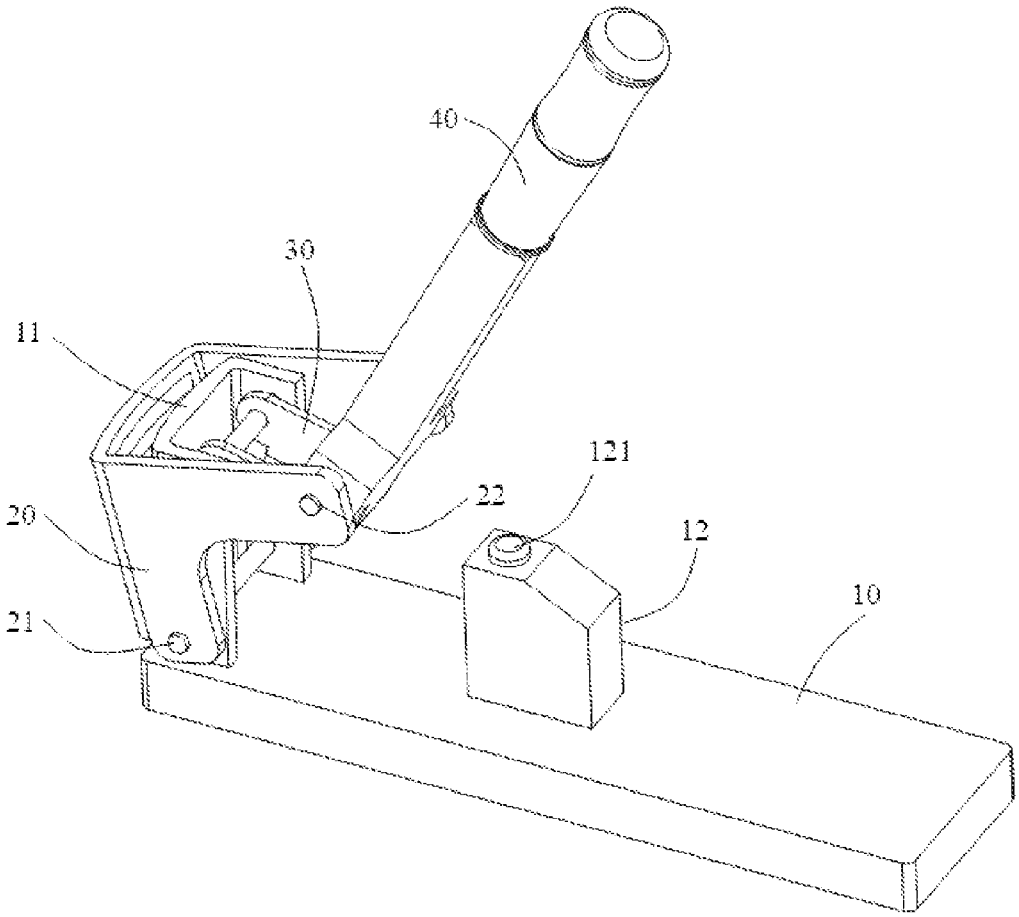
FIG. 1 is a perspective view of a pill crusher provided by a first embodiment of the present invention.
Figure 2:
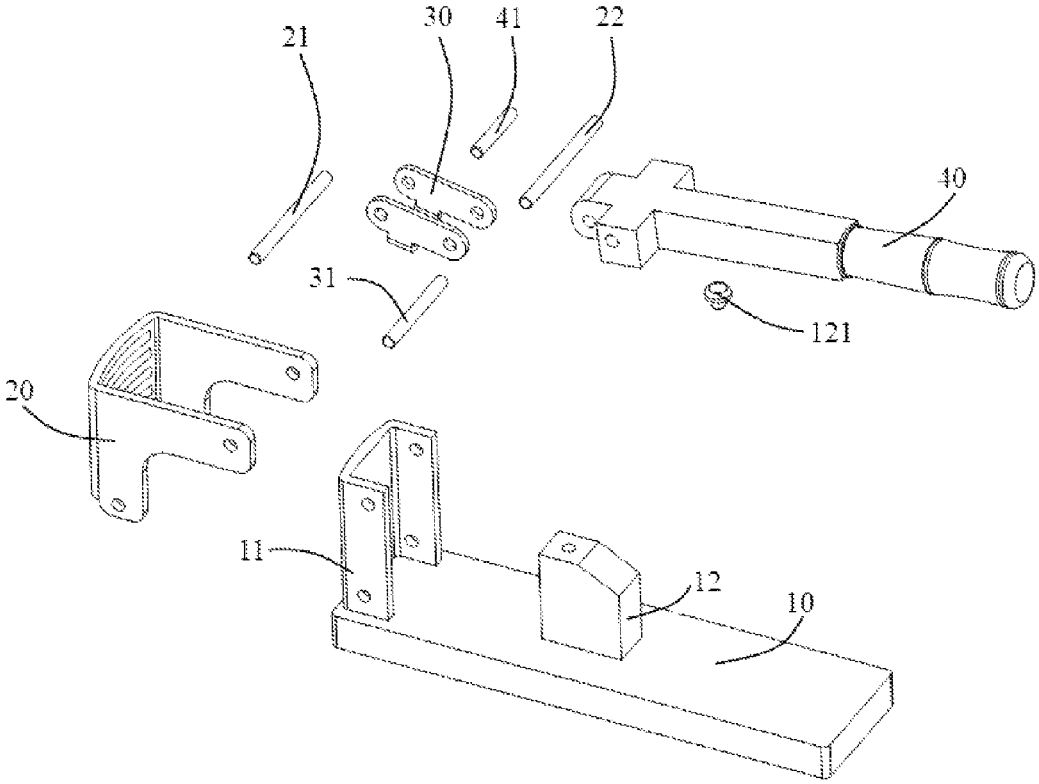
FIG. 2 is an exploded view of the pill crusher provided by the first embodiment of the present invention.

Description will be given below to illustrate the pill crusher provided by the embodiments of the present invention with reference to the accompanying drawings.

The pill crusher provided by an embodiment of the present invention comprises a base, a stopper, an U-shaped movable pressing plate, a connecting rod and a handle. The stopper is fixed or movably mounted on the base. The U-shaped movable pressing plate, provided at outside of the stopper, includes a pressing plate positioned on a first side of the stopper and two side walls connected with the pressing plate and connected pivotedly to the stopper, so that the U-shaped movable pressing plate can rotate relative to the stopper and a V-shaped crushing chamber formed between the pressing plate and the stopper is capable of being closed by pressing and being open. The connecting rod is positioned on the other side of the stopper and has a first end pivotedly connected with the stopper and a second end. The handle has a first end pivotedly connected with the second end of the connecting rod through a third shaft pin and a pivoting portion pivoted with the two side walls. With the lowering of the handle, an angle between the connecting rod and the handle is increased and a space of the V-shaped crushing chamber is gradually decreased; and with the raising of the handle, the angle between the connecting rod and the handle is reduced and the space of the V-shaped crushing chamber is gradually increased.

First Embodiment

As illustrated in FIGS. 1 to 5, the pill crusher provided by the first embodiment of the present invention comprises a base 10, an U-shaped fixed stopper 11, an U-shaped movable pressing plate 20, a connecting rod 30 and a handle 40.

A stop post 12 for limiting the pressing-down distance of the handle 40 is mounted on the base 10. A rubber pad 121 is mounted on the top of the stop post 12. That is to say, under the non-using state of pill crusher, the stop post 12 and the rubber pad 121 could support the handle 40 to be at an appropriate position for hand to hold conveniently. In addition, they can also avoid the handle 40 pressing down excessively and too much extrusion force between the U-shaped movable pressing plate 20 and the U-shaped fixed stopper 11.

The U-shaped fixed stopper 11, mounted on the base 10, includes stop plate 115 fixed on the base 10 and two side walls 111, 112. The U-shaped fixed stopper 11 herein is a preferred structure of stopper, and not limited hereto. The stopper can also be other structures, such as stop post, stop plate with axle holes and the like which can coordinate with U-shaped movable pressing plate 20 to realize the same function.

The U-shaped movable pressing plate 20, sleeved on the outside of the stopper 11, includes a pressing plate 204 positioned on a first side of the stopper 11 and two side walls 203, 205 connected with the pressing plate 204. Lower portions of the side walls 203, 205 of the U-shaped movable pressing plate 20 are pivotedly connected with lower portions of the side walls 111, 112 of the U-shaped fixed stopper 11 through a first shaft pin 21, so that the U-shaped movable pressing plate 20 can rotate relative to the stopper 11 and a V-shaped crushing chamber capable of being closed or opened is formed between the pressing plate 204 and the stopper 11. That is to say, the U-shaped movable pressing plate 20 pivots on the first shaft pin 21 relative to the U-shaped fixed stopper 11, which forms the V-shaped crushing chamber for crushing pills. In the embodiment, the side walls 203, 205 of the U-shaped movable pressing plate 20 are inverted L-shaped, but the present invention is not limited thereto.

The connecting rod 30, positioned on the other side of the stopper 11, includes a first end (namely the front end) pivotedly connected with the upper portions of the side walls 111, 112 of the U-shaped fixed stopper 11 through a second shaft pin 31, and a second end. The handle 40 has a first end pivotedly connected with the second end of the connecting rod 30 through a third shaft pin 41 and a pivoting portion pivotedly connected with the upper portions of the two side walls 203, 205 of the U-shaped movable pressing plate 20 through a fourth shaft pin 22. When the handle 40 is pressed down, the angle between the connecting rod 30 and the handle 40 is increased and the space of the V-shaped crushing chamber is gradually decreased; and when the handle 40 is raised up, the angle between the connecting rod 30 and the handle 40 is reduced and the space of the V-shaped crushing chamber is gradually increased.

The front end (namely the first end) of the connecting rod 30 is connected with the upper portions of two sides (namely the side walls 111, 112) of the U-shaped fixed stopper 11 through the shaft pin 31, and the other end of the connecting rod 30 is connected with the front end (namely the first end) of the handle 40 through the shaft pin 41. The U-shaped movable pressing plate may pivot on the shaft pin 21 which is connected with the lower portions of the two sides of the U-shaped fixed stopper 11. The rearward portion (namely the pin joint part) front end of the handle 40 may be connected with tail ends of the upper portions of the L-shaped sides of the U-shaped movable pressing plate through the shaft pin 22. The four shaft pins 21, 22, 31, 41 allow the components connected therewith to pivot on the shaft pins 21, 22, 31, 41 respectively. A force employed by an user on the handle is transferred through link mechanism to make the space between U-shaped movable pressing plate 20 and the U-shaped fixed stopper 11 increased or decreased, and thereby control the V-shaped crushing chamber open or closed.

In the pill crusher provided by the first embodiment of the present invention, by connecting the bottom of the U-shaped movable pressing plate with the bottom of the two side walls of the U-shaped fixed stopper 11, connecting the front end of the connecting rod 30 with the upper portion of the U-shaped fixed stopper 11, connecting the front end of the handle 40 with the rear end of the connecting rod 30, and connecting the rearward portion of the front end of the handle 40 with the tail end of the upper portion of the U-shaped movable pressing plate 20, the movement of the handle 40 can be converted into the pivot of the U-shaped movable pressing plate. Thereby, as the handle 40 rotates, the U-shaped movable pressing plate 20 is driven to pivot on the shaft pin 21 to produce the pressing action applied to the U-shaped fixed stopper 11. While a plastic pouch with the pills to be crushed therein is placed between the U-shaped movable pressing plate 20 and the U-shaped fixed stopper 11, pills can be crushed or pulverized through the pivot movement of the U-shaped movable pressing plate 20 towards the U-shaped fixed stopper 11.

The stop plate 115 or the pressing plate 204 is provided with a plurality of anti-slip stripes 113, 114 or anti-slip patterns, but the present invention is not limited thereto. The surface of the U-shaped movable pressing plate 20 and/or the U-shaped fixed stopper 11 in the embodiments of the present invention may be provided with protruding anti-slip stripes and/or patterns, e.g., horizontal stripes, oblique stripes and vertical stripes, in order to prevent pills from slipping along the pressing plate due to the pressing action, and further improve the efficiency and the effectiveness of pill crushing.

Figure 3:
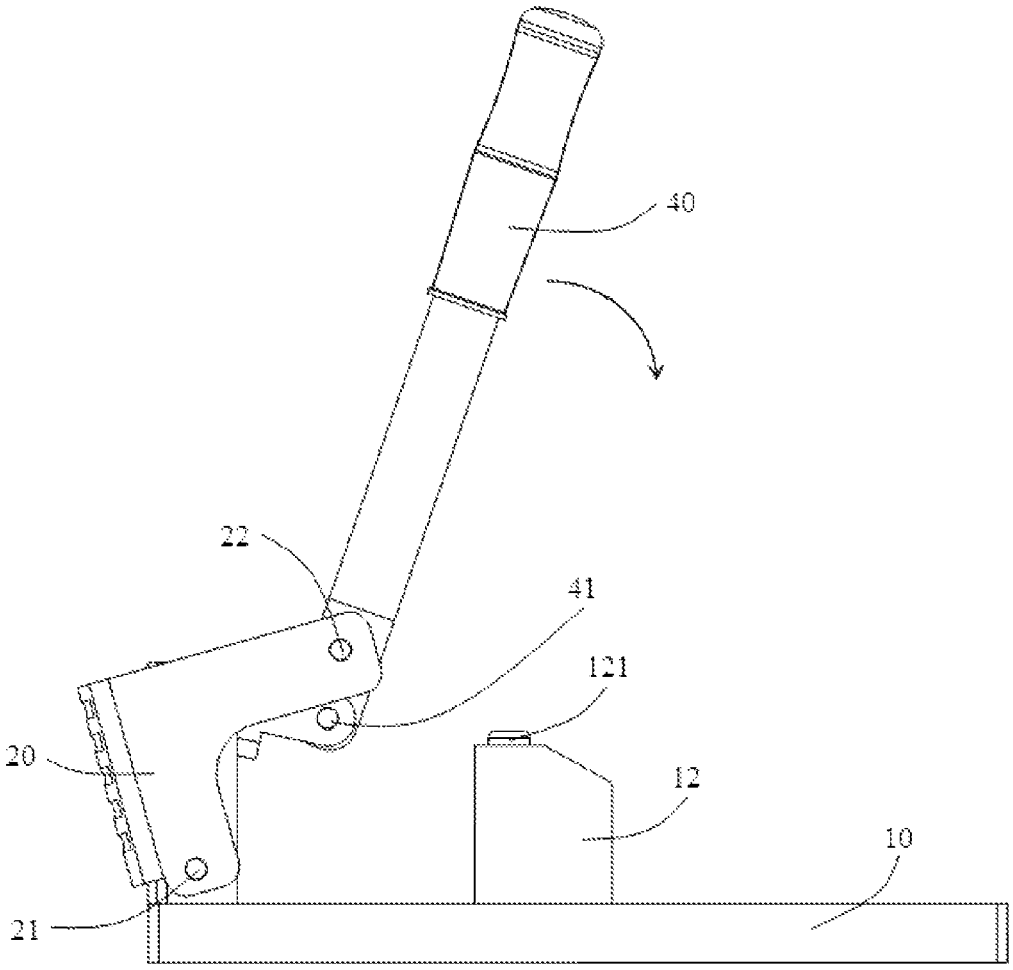
FIG. 3 is a state view of the pill crusher as shown in FIG. 1 illustrating the state when a handle is raised before pill crushing.
Figure 4:
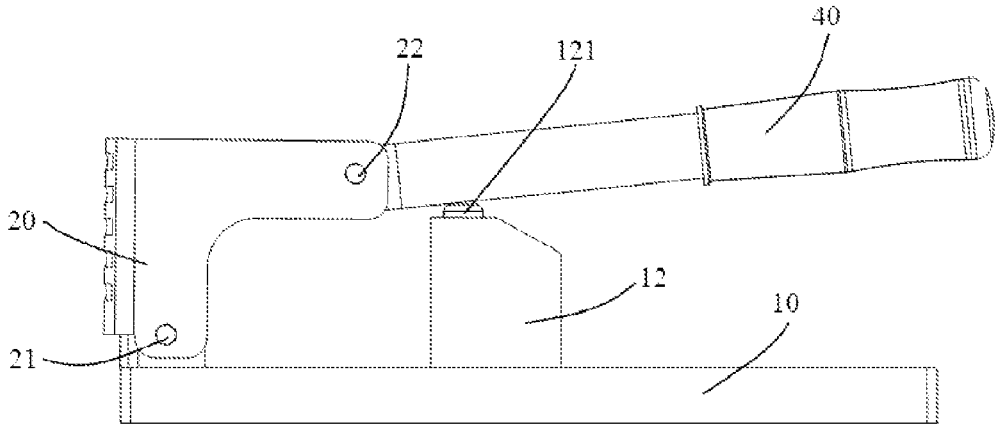
FIG. 4 is a state view of the pill crusher as shown in FIG. 1 illustrating the state after the handle is lowered during the pill crushing.
Figure 5:
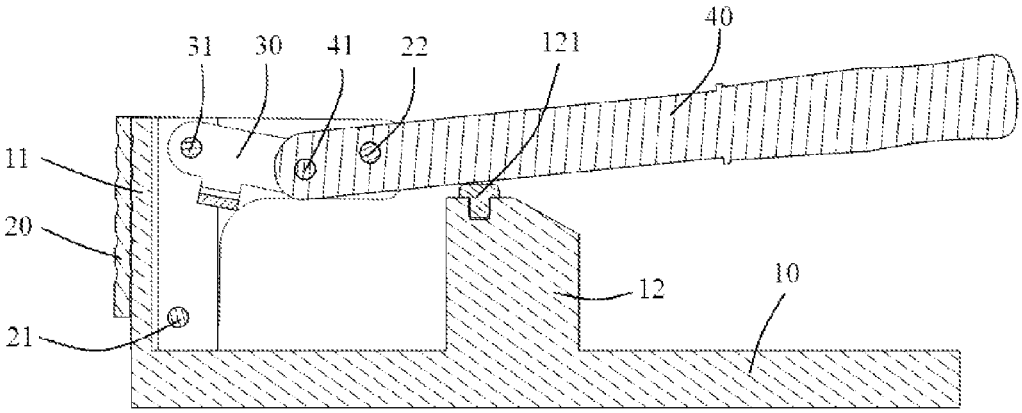
FIG. 5 is a longitudinal sectional view of the pill crusher in the state as shown in FIG. 4.

The operating process of the pill crusher provided by the first embodiment of the present invention will be described below mainly with reference to FIGS. 3 to 5: before pill crushing, as illustrated in FIG. 3, the free end (one end not connected with the connecting rod 30) of the handle 40 is raised up and the U-shaped movable pressing plate 20 is driven to pivot away from the U-shaped fixed stopper 11; and then, the plastic pouch filled with the pills is placed between the U-shaped movable pressing plate 20 and the U-shaped fixed stopper 11; after that, the handle 40 is pressed down by the direction of arrow as shown in FIG. 3. Then, the U-shaped movable pressing plate 20 which is pulled by the connecting rod 30 and the handle 40 moves towards the U-shaped fixed stopper 11 to crush or pulverize the pills placed between the U-shaped movable pressing plate 20 and the U-shaped fixed stopper 11. When the handle 40 is completely pressed down, the handle would stop by contacting against the rubber pad 121 on the stop post 12, as shown in FIGS. 4 and 5 or by hanging above the rubber pad 121 while lots of pills are crushed at a time.

The pill crusher provided by the first embodiment of the present invention has the advantages that:

Firstly, the pill crusher provided by the embodiment of the present invention fully utilizes the mechanical principle of lever, maximally magnifies and converts the strength at the free end of the handle 40 to the pressing region to produce effective pill crushing operation. It is labor-saving and can reduce the potential injuries caused by long-term use to the wrist and the elbow of an user.

More specifically, in the pressing process, when the handle 40 is further pressed down, the U-shaped movable pressing plate 20 is further pulled toward the U-shaped fixed stopper 11. If density of the pills is greater, the resistance produced by pill pieces in the crushing region is becoming larger and larger during the process of crushing, which can be transferred to handle 40 and make users feel more tired. However, the pill crusher provided by the present invention has the following advantages: since the pivots of the handle 40 and the shaft pin 31 connecting the connecting rod 30 and the upper portions of the two sides of the U-shaped fixed stopper 11 are all close to the end portion of the handle 40, the strength at the free end of the handle 40 can be maximally magnified, based on the lever principle, in the case that the length of the handle 40 remains the same. Moreover, when the free end of the handle 40 is further pressed down, the shaft pin 31, as the fixed pivot, and the shaft pins 41 and 22, as the movable pivots, are more likely to be lined in a straight line, namely the angle formed between the handle 40 and the connecting rod 30 is more close to 180 degrees, which produces a larger magnification factor of the strength to produce a greater pull force to pull the U-shaped movable pressing plate 20 towards the U-shaped fixed stopper 11 and get a better pill crushing effect and labor saving. Meanwhile, the larger resistance from the crushed pills is, the larger favorable leverage ratio is for the feeling of effort-saving.

Secondly, as the bottom of the pressing region formed by the reverse L-shaped sides of the U-shaped movable pressing plate 20 and the U-shaped fixed stopper 11 is open, the accumulation of sewage or dust or medicinal powder leaked from the pill pouch due to the accidental break of the pill pouch can be avoided, and meanwhile it is convenient to do the maintenance and cleaning for sanitation.

Thirdly, as all the mechanical motions of the pill crusher provided by the embodiment of the present invention are achieved by the pivot movement on the shaft pins, not sliding mechanism, it realizes the low-noise operation and is thereby particularly suitable for quiet medical institutions without disturbing patients' rest or working medical personnel's work.

Fourthly, the surface of the U-shaped movable pressing plate 20 and/or the U-shaped fixed stopper 11 in the embodiment of the present invention may be provided with stripes and/or patterns, e.g., horizontal stripes, oblique stripes and vertical stripes, in order to prevent pills from slipping along the pressing plate due to the pressing action, and further improve the efficiency and the effectiveness of pill crushing.

Finally, the pill crusher provided by the embodiment of the present invention can be produced by simple sheet-metal processing, for example, it can be produced by using medical-grade stainless steel as main material without high-cost processing means such as metal casting and machining. Therefore, the pill crusher provided by the embodiment of the present invention not only reduces the cost but also completely avoids the possibility of potential pill contamination caused by the coating materials of surface treatment process such as coating materials which fall into an accidentally broken pill pouch.

Second Embodiment

Figure 6:
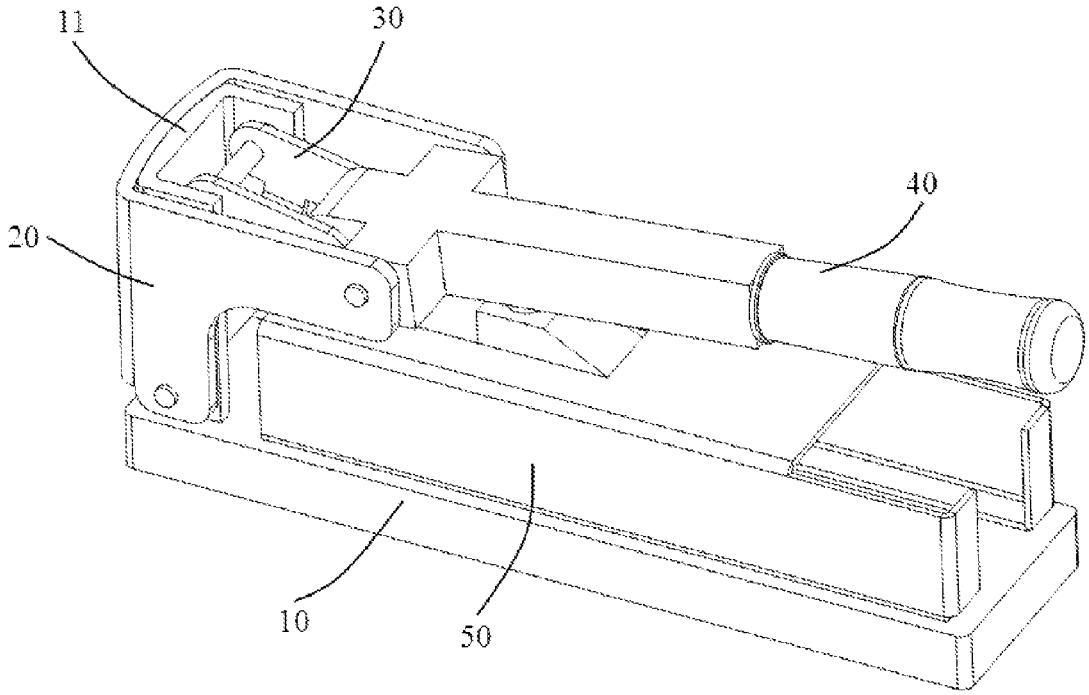
FIG. 6 is a perspective view of a pill crusher provided by a second embodiment of the present invention.
Figure 7:
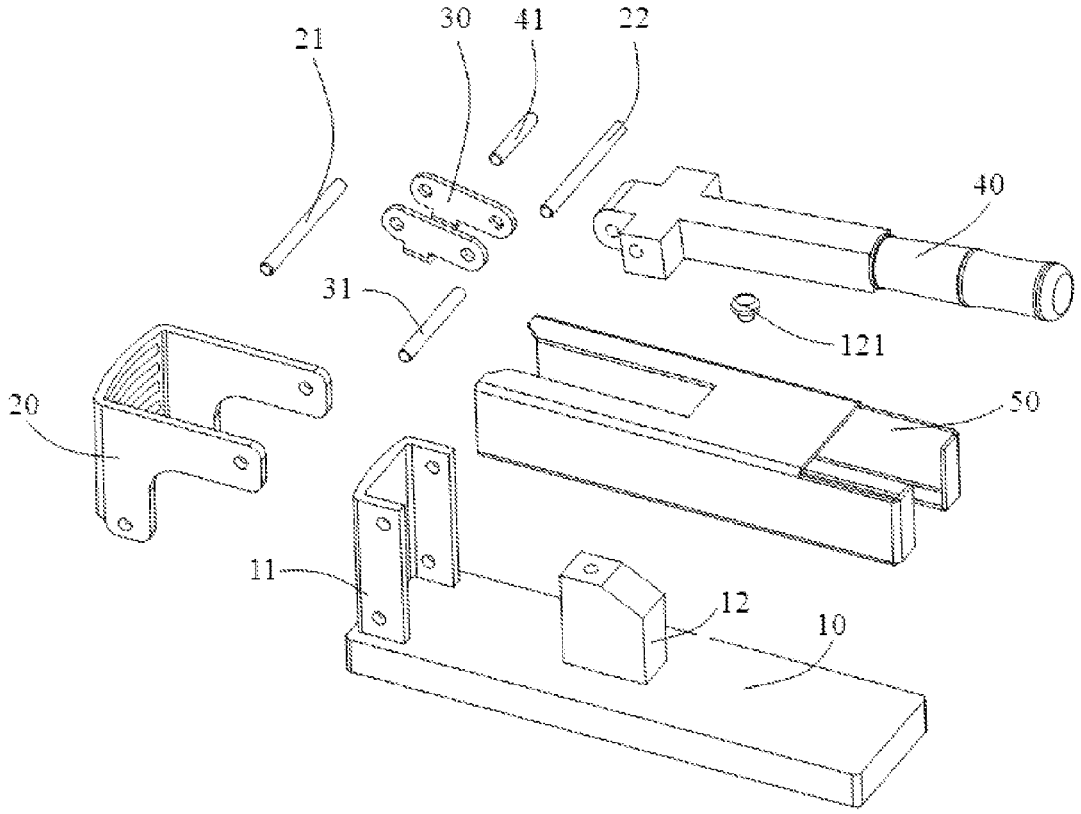
FIG. 7 is an exploded view of the pill crusher provided by the second embodiment of the present invention.
Figure 8:
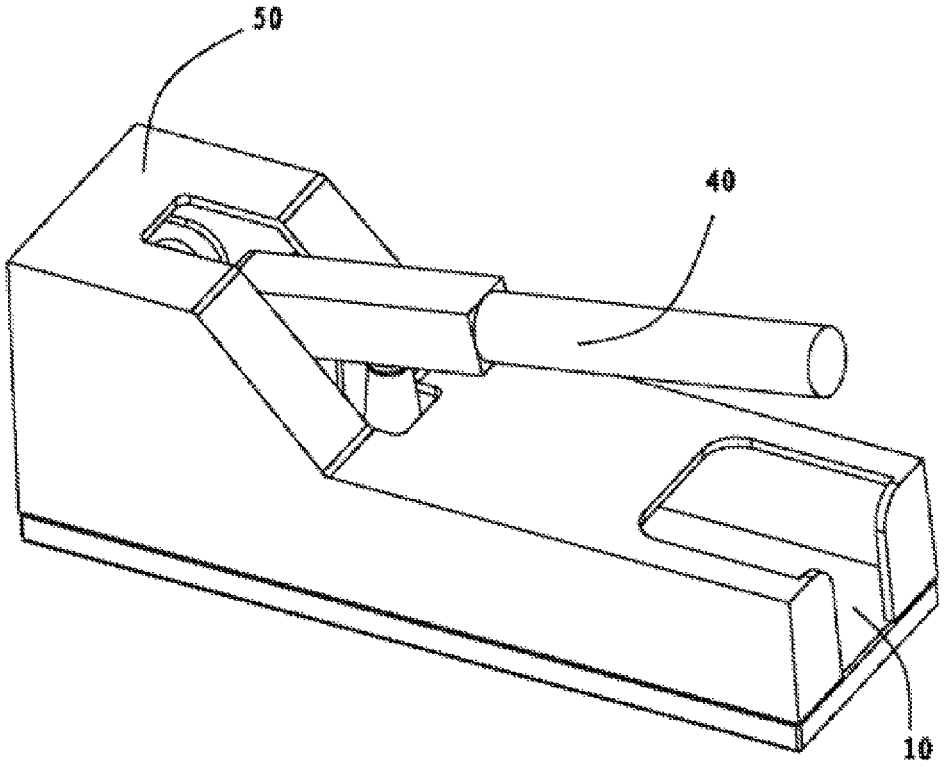
FIG. 8 is a perspective view of a pill crusher provided by a third embodiment of the present invention.
Figure 9:
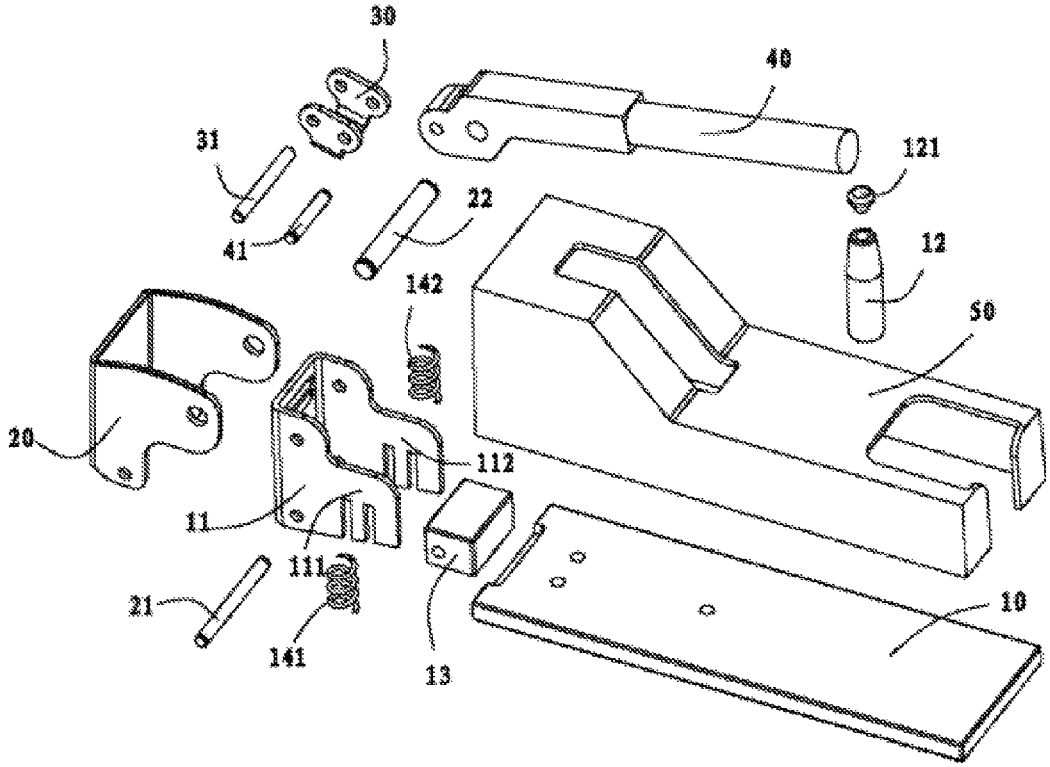
FIG. 9 is an exploded view of the pill crusher provided by the third embodiment of the present invention.
Figure 10:
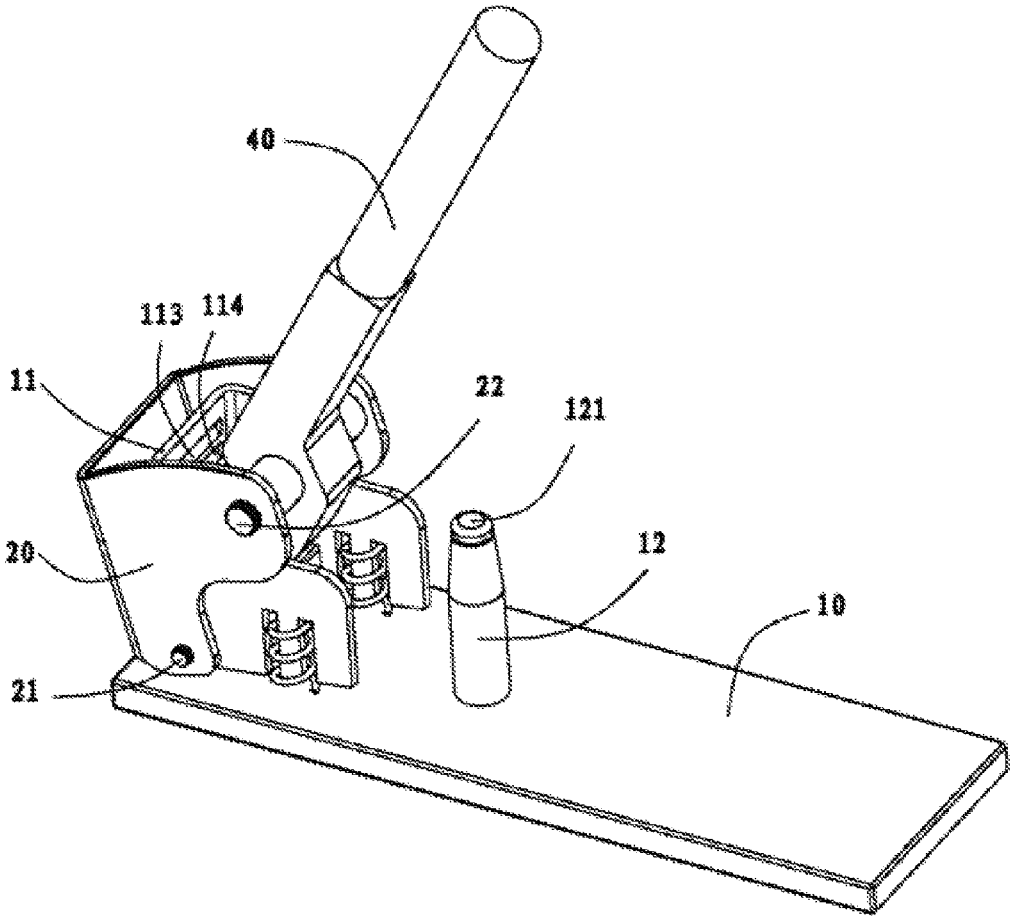
FIG. 10 is a perspective view of the pill crusher provided by the third embodiment of the present invention with the upper cover removed.
Figure 11:
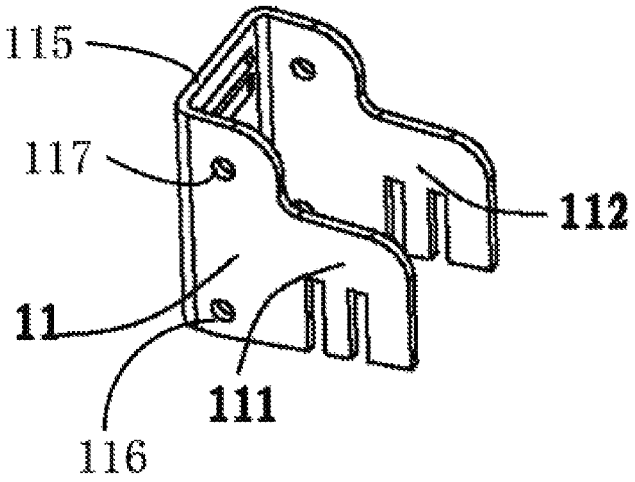
FIG. 11 is a perspective view of an U-shaped semi-fixed stopper in the pill crusher provided by the third embodiment of the present invention.
Figure 12:
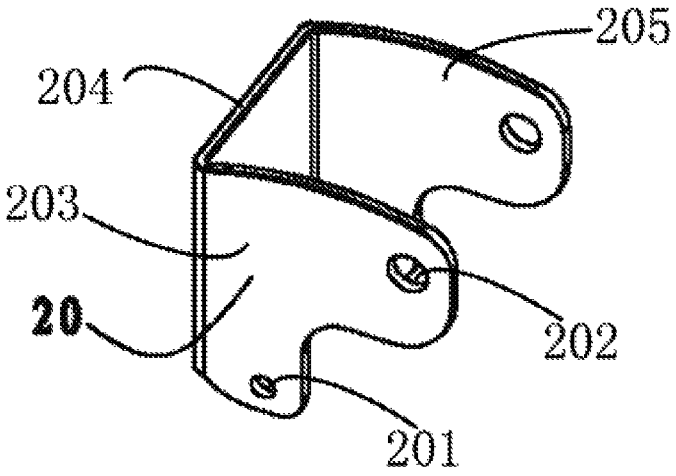
FIG. 12 is a perspective view of an U-shaped movable pressing plate in the pill crusher provided by the third embodiment of the present invention.

As illustrated in FIGS. 6 and 7, the pill crusher provided by the second embodiment of the present invention comprises a base 10, an U-shaped fixed stopper 11, an U-shaped movable pressing plate 20, a connecting rod 30, a handle 40 and an upper cover 50. The position, connection relationship and working principle of the base 10, the U-shaped fixed stopper 11, the U-shaped movable pressing plate 20, the connecting rod 30, the handle 40 and shaft pins 21, 31, 41, 22 in the second embodiment of the present invention are the same as those of the first embodiment. No further description will be given herein. Compared with the first embodiment, the second embodiment of the present invention is different in that an upper cover 50 is further included. The upper cover 50 is detachably mounted on the base 10, and a pill crusher pouch dispenser is formed between the upper cover 50 and the base 10. A certain number of plastic pill crusher pouches may be stored in the pill crusher pouch dispenser, which is convenient for users to get the pouches to operate crushing.

Meanwhile, the stop post 12 also maintains the distance between the handle 40 and the upper cover 50 of the pill crusher pouch dispenser for holding the handle conveniently.

Third Embodiment

As illustrated in FIGS. 8 to 15, the pill crusher provided by the third embodiment of the present invention comprises a base 10, an U-shaped semi-fixed stopper 11, an U-shaped movable pressing plate 20, a connecting rod 30, a handle 40 and an upper cover 50. The base 10, the U-shaped movable pressing plate 20, the connecting rod 30 and the handle 40 in the third embodiment of the present invention are similar to those of the first embodiment. (In order to more clearly see the position relationship and working principle of various components in the pill crusher, the upper cover 50 is removed in FIGS. 10 to 15.) Compared with the first embodiment, the third embodiment of the present invention is different in that the U-shaped semi-fixed stopper 11 is not fixed on the base but can slightly pivot in a wedge space 143 reserved between the base and the U-shaped semi-fixed stopper 11.

Specifically, the U-shaped semi-fixed stopper 11, mounted on the base 10, includes a stop plate 115 and two side walls 111, 112. Lower portions of the side walls 111, 112 of the U-shaped semi-fixed stopper 11 are pivotedly connected with a fixed block 13 on the base 10. Upper portions of the side walls 111, 112 of the U-shaped semi-fixed stopper 11 are pivotedly connected with a first end of the connecting rod 30 through a second shaft pin 31. Free ends of two side walls 111, 112 of U-shaped semi-fixed stopper 11 are provided with compressible buffer springs 141, 142 respectively. One end of each buffer spring 141, 142 abuts against the side wall of U-shaped semi-fixed stopper 11 elastically and the other end is elastically supported on the base 10 to form a wedge space 143 between bottom edges of the side walls 111, 112 of the U-shaped semi-fixed stopper 11 and the base 10. The free end of each of two side walls 111, 112 of U-shaped semi-fixed stopper 11 is provided with an m-shaped notch for accommodating the buffer springs 141, 142. The buffer springs 141, 142 are respectively embedded into the m-shaped notches.

The U-shaped movable pressing plate 20, sleeved on the outside of the U-shaped semi-fixed stopper 11, includes a pressing plate 204 positioned on a first side of the U-shaped semi-fixed stopper 11 and two side walls 203, 205 connected with the pressing plate 204 and pivotedly connected to the U-shaped semi-fixed stopper 11, so that the U-shaped movable pressing plate 20 can rotate relative to the U-shaped semi-fixed stopper 11 and a V-shaped crushing chamber capable of being closed or opened is formed between the pressing plate 204 and the U-shaped semi-fixed stopper 11.

In the embodiment, the side walls 111, 112 of the U-shaped semi-fixed stopper 11 are L-shaped, and the side walls 203, 205 of the U-shaped movable pressing plate 20 are inverted L-shaped. But the shape is not limited thereto and the side walls may be in other shapes. Lower portions of the side walls 203, 205 of the U-shaped movable pressing plate 20 are pivotedly connected with lower portions of the side walls 111, 112 of the U-shaped semi-fixed stopper 11 through a first shaft pin 21, and upper portions of the side walls 203, 205 of the U-shaped movable pressing plate 20 are pivotedly connected with the handle 40 through a fourth shaft pin 22.

The connecting rod 30, positioned on the other side of the U-shaped semi-fixed stopper 11, has a first end pivotedly connected with the U-shaped semi-fixed stopper 11 and a second end. The handle 40 has a first end pivotedly connected with the second end of the connecting rod 30 through a third shaft pin 41 and a pivoting portion pivotedly connected with the two side walls 203, 205. When the handle 40 is pressed down, the angle between the connecting rod 30 and the handle 40 increases and the space of the V-shaped crushing chamber gradually decreases; and when the handle 40 is raised up, the angle between the connecting rod 30 and the handle 40 reduces and the space of the V-shaped crushing chamber gradually increases.

As similar to the first embodiment, the surface of the U-shaped movable pressing plate 20 and/or the U-shaped semi-fixed stopper 11 in the second embodiment of the present invention may also be provided with stripes and/or patterns to further improve the efficiency and the effectiveness of pill crushing.

The pill crusher further comprises an upper cover 50 which is detachably mounted on the base 10, and a pill crusher pouch dispenser is formed between the upper cover 50 and the base 10. The upper cover 50 also partially covers the U-shaped semi-fixed stopper 11 and the U-shaped movable pressing plate 20 and is provided with an opening for the handle 40 to extend outwards. Although the upper cover 50 covers most components of the pill crusher, an opening between the U-shaped movable pressing plate 20 and the U-shaped semi-fixed stopper 11 is at least exposed when the V-shaped crushing chamber is opened, in order not to block pill pouches into the V-shaped crushing chamber. Moreover, as the upper cover 50 covers the connecting rod 30, the shaft pins 21, 22, 31, 41 and the like, it avoids the problem of cross-contamination due to dust accumulation between the shaft pins and the connecting rod and improves the overall appearance of the pill crusher without adverse effect on the normal use.

In the non-using state of pill crusher, the stop post 12 with rubber pad 121 mounted at the base 10 could support the handle 40 to be at an appropriate position and maintain the distance between the handle 40 and the upper cover 50 of the pill crusher pouch dispenser for holding the handle 40 conveniently.

In summary, upper portions and lower portions of two sides (namely the side walls) of the U-shaped semi-fixed stopper 11 are respectively provided with a pair of axle holes for fixing the shaft pins; the bottom of the U-shaped movable pressing plate 20 is connected with the lower portions of the two sides of the U-shaped semi-fixed stopper 11 through the shaft pin 21; the U-shaped movable pressing plate 20 may pivot on the shaft pin 21 relative to the U-shaped semi-fixed stopper to implement the pressing action; the front end of the connecting rod 30 is connected with the upper portions of the two sides of the U-shaped semi-fixed stopper 11 through the shaft pin 31, and the other end of the connecting rod 30 is connected with the front end (namely the first end) of the handle through the shaft pin 41; the rearward portion (namely the pivoting portion) of front end of the handle is connected with the tail end of the upper portion of the U-shaped movable pressing plate 20 through the shaft pin 22; the U-shaped movable pressing plate 20 may pivot on the shaft pin 21 connected with the lower portions of the two sides of the U-shaped semi-fixed stopper 11; and the rearward portion of front end of the handle may be connected with the tail ends of the upper portions of the L-shaped sides of the U-shaped movable pressing plate through the shaft pin 22. The four shaft pins 21, 22, 31, 41 allow components connected therewith to pivot on the shaft pins 21, 22, 31, 41 respectively.

In the pill crusher provided by the embodiment of the present invention, by connecting the bottom of the U-shaped movable pressing plate 20 with the bottom of the two sides of the U-shaped semi-fixed stopper 11, connecting the front end of the connecting rod 30 with the upper portion of the U-shaped semi-fixed stopper 11, connecting the front end of the handle 40 with the rear end of the connecting rod 30, connecting the rearward portion of the front end of the handle 40 with the tail end of the upper portion of the U-shaped movable pressing plate 20, the movement of the handle 40 can be converted into the pivot of the U-shaped movable pressing plate. Thereby, as the handle 40 rotates, the U-shaped movable pressing plate 20 is driven to pivot on the shaft pin 21 to produce the pressing action applied to the U-shaped semi-fixed stopper 11. While a plastic pouch with the pills to be crushed therein is placed between the U-shaped movable pressing plate 20 and the U-shaped semi-fixed stopper 11, pills can be crushed or pulverized through the pivot movement of the U-shaped movable pressing plate 20 towards the U-shaped semi-fixed stopper 11.

Figure 13:
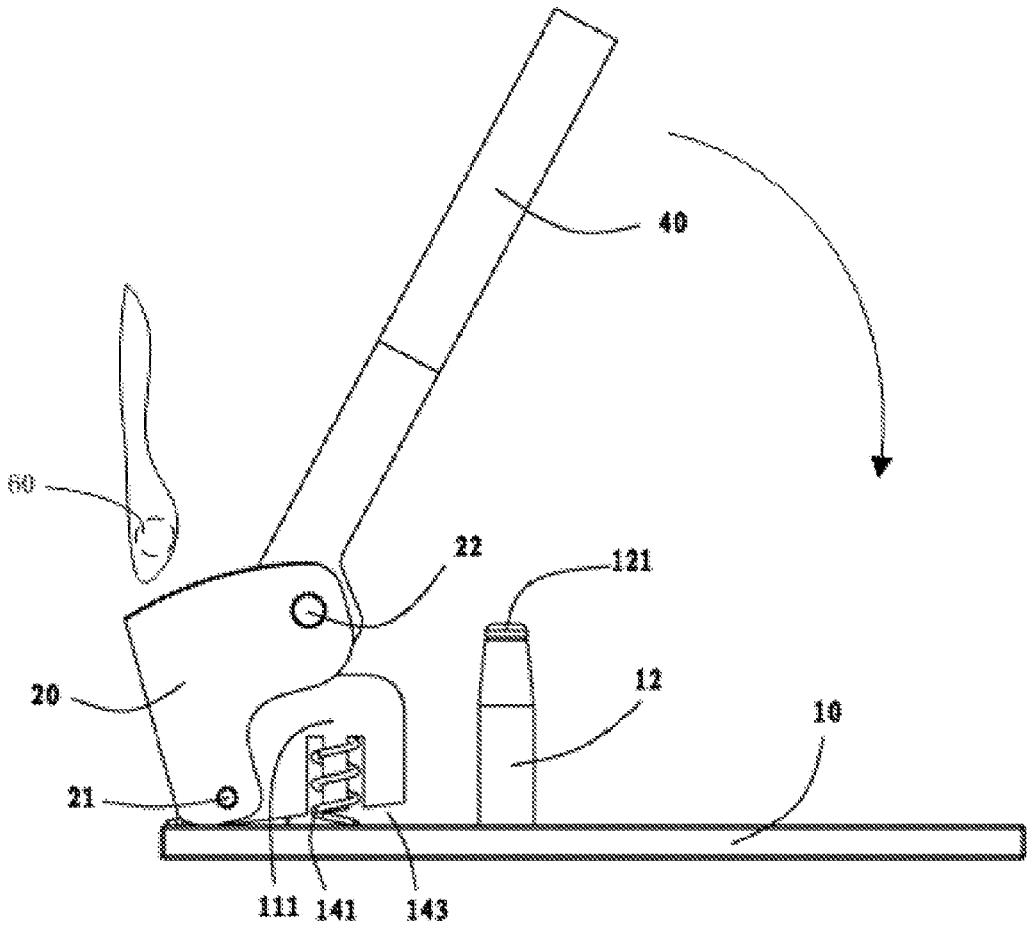
FIG. 13 is a schematic view illustrating the open state of the pill crusher provided by the third embodiment of the present invention.
Figure 14:
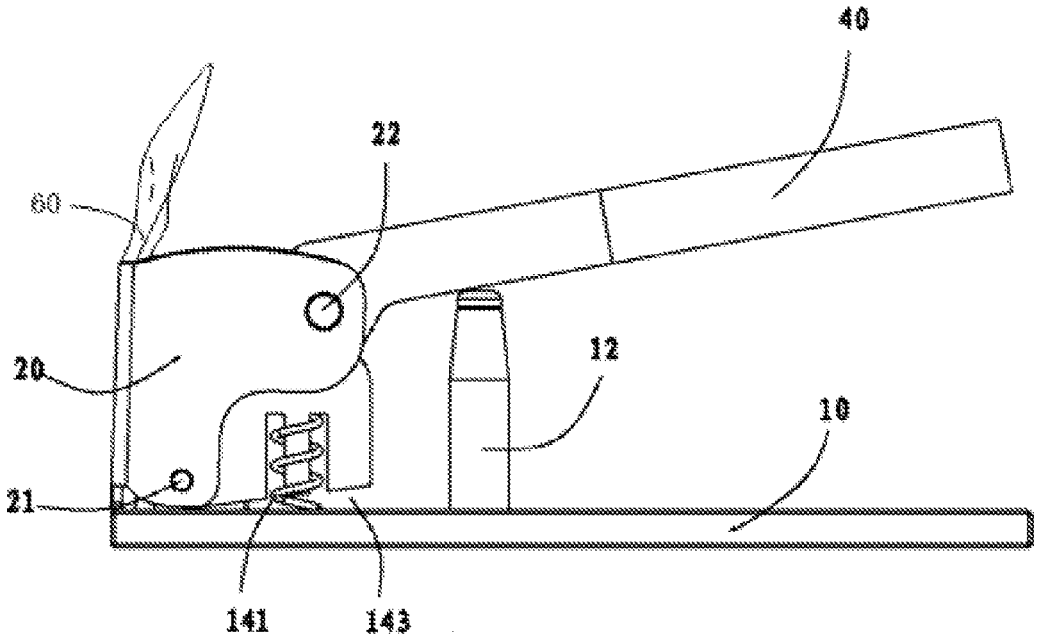
FIG. 14 is a schematic view illustrating the pressing-closed state of pill crusher provided by the third embodiment of the present invention.
Figure 15:
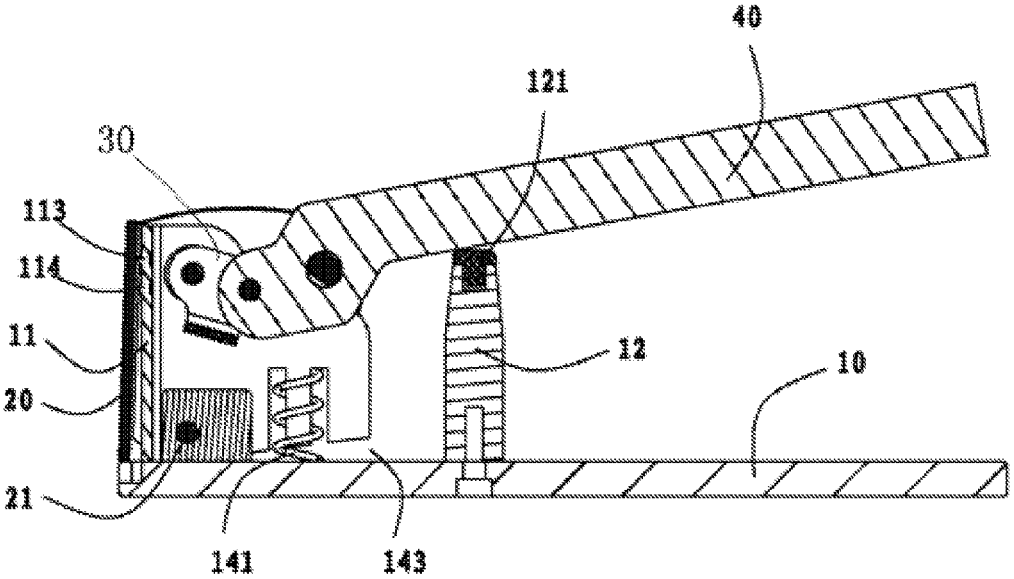
FIG. 15 is a longitudinal sectional view of the pill crusher in the pressing-closed state provided by the third embodiment of the present invention.

The specific operating process of the embodiment of the present invention is as follows:

Before pill crushing, as illustrated in FIG. 13, the free end (one end not connected with the connecting rod 30) of the handle 40 is raised up and the U-shaped movable pressing plate 20 is driven to pivot away from the U-shaped semi-fixed stopper 11; and then, the plastic pouch filled with the pills is placed between the U-shaped movable pressing plate 20 and the U-shaped semi-fixed stopper 11; after that, the handle 40 is pressed down by the direction of arrow as shown in FIG. 13. Then, the U-shaped movable pressing plate 20 which is pulled by the connecting rod 30 and the handle 40 moves towards the U-shaped semi-fixed stopper 11 to crush or pulverize the pills between the U-shaped movable pressing plate 20 and the U-shaped semi-fixed stopper 11. The pill crusher with the handle pressed down is as shown in FIGS. 14 and 15. At this point, the U-shaped semi-fixed stopper 11 subjected to the continued pressing can compress the springs fixed under the two sides and thereby pivot slightly on shaft pin 21 in the reserved wedge space 143 toward the base, buffering the pressing force of the movable pressing plate 20. That is to say, the U-shaped semi-fixed stopper 11 may correspondingly move backwards by the pressing motion of the inverted L-shaped movable pressing plate 20, which effectively buffers the pressing force directly transferred from the pressing plate 20 to the handle 40 and makes the user feel labor-saving and easy.

Obviously, the pill crusher provided by the embodiment of the present invention fully utilizes the mechanical principle of lever, maximally magnifies and converts the strength at the free end of the handle 40 to the pressing region to produce effective pill crushing operation. It is labor-saving and can reduce the potential injuries to the wrist and the elbow of an user due to long-term use. Moreover, in this embodiment, a wedge space 143 formed by the buffer springs 141, 142 positioned between the semi-fixed stopper 11 and the base 10, ensures the pressure required for effective pill crushing and meanwhile can effectively buffer the superfluous strength from the handle and produce the labor-consuming feeling.

Fourth Embodiment

Figure 16:
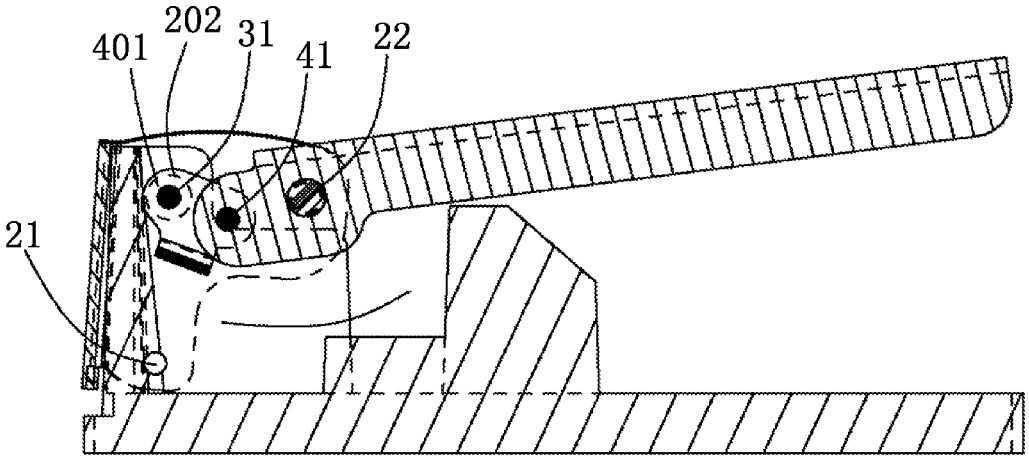
FIG. 16 is a longitudinal sectional view of a pill crusher provided by a fourth embodiment of the present invention.

The embodiment is different from the third embodiment in that: as illustrated in FIG. 16, on the basis of the first embodiment, elastic bushes 401 are mounted in the axle holes for one or more of the second shaft pin 31, the third shaft pin 41 and the fourth shaft pin 22 respectively. Then, during the handle exerts force, all the three shaft pins may slightly move by pressing the elastic bushes 401, and hence the angle among the three shaft pins can be changed and the magnification factor of the lever can be adjusted. When the pressing region (i.e. V-shaped crushing chamber) cannot be rapidly reduced, the lowering (i.e. pressed down) distance of the handle is changed so as to have the buffer function and increase the "labor-saving" feeling of the user.

The main difference of the fourth embodiment shown in FIGS. 14 and 15 from the third embodiment is that the elastic bushes 401 in the axle holes restore the shaft pins to normal positions by elasticity after the pressure of the handle 40 is removed. All the other components are the same as those of the first embodiment. No further description will be given herein.

Fifth Embodiment

In the embodiment, on the basis of the third embodiment, elastic bushes 401 are mounted in the axle holes for one or more of the second shaft pin 31, the third shaft pin 41 and the fourth shaft pin 22 respectively. That is to say, it has not only the buffer structure of the third embodiment, in which the wedge space 143 is formed between the U-shaped semi-fixed stopper 11 and the base 10 by the buffer springs 141, 142, but also the buffer structure of the fourth embodiment, in which the elastic bushes 401 are used for buffering, and hence it can more fully buffer the superfluous strength from the handle and produce the labor-consuming feeling.

In summary, the pill crusher provided by the present invention, having the V-shaped crushing chamber and the connecting rod, is good for users, particularly for users in medical institutions. Moreover, the pill crusher provided by the embodiments of the present invention fully utilizes the labor-saving principle of lever, particularly constructs a compressible and restorable wedge region via two buffer springs, which can greatly buffer the reaction force of pill crushing and reduce the burden of the users and particularly the potential injuries to the wrist and elbow of medical personnel due to long-term use. Meanwhile, due to anti-slip structures at the open pressing region and the pressing surface, the pill crusher provided by the present invention can not only prevent the potential sliding of the pills in the pill pouches during the crushing and improve the efficiency and the crushing effect, but also be convenient in cleaning and prevent cross-contamination. Therefore, the pill crusher provided by present invention has the advantages of safety, labor saving, high efficiency, quietness, easy operation, low cost, convenient to maintain and clean, effectively preventing cross-contamination and the like.

The foregoing only illustrates the specific embodiments of the present invention. It should be understood that the present invention is not limited to the above specific embodiments and various deformations or modifications can be made by those skilled in the art within the scope of the claims without affecting the essence of the present invention.

What is claimed is:

1. A pill crusher, comprising:

a base;

a stopper, mounted on the base;

an U-shaped movable pressing plate, sleeved on outside of the stopper and comprising a pressing plate on one side of the stopper and two side walls connected with the pressing plate and pivotedly connected with the stopper, so that the U-shaped movable pressing plate can rotate relative to the stopper and a V-shaped crushing chamber formed between the pressing plate and the stopper is capable of being closed by pressing and being open;

a connecting rod, positioned on the other side of the stopper and having a first end pivotedly connected with the stopper and a second end;

a handle, having a first end pivotedly connected with the second end of the connecting rod through a third shaft pin and a pivoting portion pivotedly connected with the two side walls;

as the handle is pressed down, an angle between the connecting rod and the handle increases and a space of the V-shaped crushing chamber decreases gradually; and as the handle is raised up, the angle between the connecting rod and the handle reduces and the space of the V-shaped crushing chamber increases gradually.

2. The pill crusher according to claim 1, wherein the stopper is an U-shaped fixed stopper including a stop plate fixed on the base and two side walls;

lower portions of the two side walls of the U-shaped movable pressing plate are pivotedly connected with lower portions of the two side walls of the U-shaped fixed stopper through a first shaft pin;

upper portions of the two side wall of the U-shaped fixed stopper are pivotedly connected with the first end of the connecting rod through a second shaft pin; and upper portions of the two side walls of the U-shaped movable pressing plate are pivotedly connected with the pivoting portion of the handle through a fourth shaft pin.

3. The pill crusher according to claim 1, wherein the stopper is an U-shaped semi-fixed stopper including a stop plate and two side walls;

lower portions of the two side walls of the U-shaped movable pressing plate are pivotedly connected with lower portions of the two side walls of the U-shaped semi-fixed stopper through a first shaft pin;

upper portions of the two side walls of U-shaped semi-fixed stopper are pivotedly connected with the first end of the connecting rod through a second shaft pin; and upper portions of the two side walls of the U-shaped movable pressing plate are pivotedly connected with the handle through a fourth shaft pin.

4. The pill crusher according to claim 3, wherein the lower portions of the two side walls of U-shaped semi-fixed stopper are pivotedly connected with a fixed block on the base; free ends of the two side walls of U-shaped semi-fixed stopper are provided with compressible buffer springs respectively; one end of each buffer spring abuts against the side wall of U-shaped semi-fixed stopper elastically and the other end is elastically supported on the base to form a wedge space between bottom edges of the two side walls of the U-shaped semi-fixed stopper and the base.

5. The pill crusher according to claim 4, wherein the free end of each side wall of the U-shaped semi-fixed stopper is provided with an m-shaped notch for accommodating the buffer spring.

6. The pill crusher according to claim 2, wherein one or more of the second shaft pin, the third shaft pin and the fourth shaft pin is sleeved by an elastic bush.

7. The pill crusher according to claim 3, wherein one or more of the second shaft pin, the third shaft pin and the fourth shaft pin is sleeved by an elastic bush.

8. The pill crusher according to claim 4, wherein one or more of the second shaft pin, the third shaft pin and the fourth shaft pin is sleeved by an elastic bush.

9. The pill crusher according to claim 5, wherein one or more of the second shaft pin, the third shaft pin and the fourth shaft pin is sleeved by an elastic bush.

10. The pill crusher according to claim 1, wherein a stop post for limiting a pressing-down distance of the handle is mounted on the base.

11. The pill crusher according to claim 10, wherein a rubber pad is mounted on the top of the stop post.

12. The pill crusher according to claim 3, wherein the stop plate or the pressing plate is provided with a plurality of anti-slip stripes or anti-slip patterns.

13. The pill crusher according to claim 3, wherein the two side walls of the U-shaped semi-fixed stopper are L-shaped.

14. The pill crusher according to claim 1, wherein the two side walls of the U-shaped movable pressing plate are inverted L-shaped.

15. The pill crusher according to claim 1, wherein the pill crusher further comprises an upper cover detachably mounted on the base; and a pill crusher pouch dispenser is formed between the upper cover and the base.

16. The pill crusher according to claim 15, wherein the upper cover partially covers the stopper and the U-shaped movable pressing plate, and has an opening for the handle to extend outwards.

* * * * *